US007926389B1

(12) United States Patent
Davis

(10) Patent No.: US 7,926,389 B1
(45) Date of Patent: Apr. 19, 2011

(54) HYDRAULIC TORQUE WRENCH WITH CENTRAL STRAIN DECOUPLED GLOBAL HOSE CONNECT SWIVEL

(76) Inventor: John D. Davis, Las Vegas, NV (US)

( * ) Notice: Subject to any disclaimer, the term of this patent is extended or adjusted under 35 U.S.C. 154(b) by 110 days.

(21) Appl. No.: 12/258,464

(22) Filed: Oct. 27, 2008

(51) Int. Cl.
*B25B 13/46* (2006.01)

(52) U.S. Cl. ..... 81/57.39; 81/57.44

(58) Field of Classification Search ..... 81/57.39, 81/57.44

See application file for complete search history.

(56) References Cited

U.S. PATENT DOCUMENTS

| | | | | |
|---|---|---|---|---|
| 5,311,796 | A * | 5/1994 | Junkers | 81/57.39 |
| 6,598,502 | B1 * | 7/2003 | Rosa | 81/57.39 |
| 6,912,933 | B2 * | 7/2005 | Knopp et al. | 81/57.39 |
| 7,062,993 | B2 * | 6/2006 | Shaw et al. | 81/57.39 |
| 7,082,858 | B2 * | 8/2006 | Knopp et al. | 81/57.39 |
| 2004/0200320 | A1 * | 10/2004 | Knopp et al. | 81/57.39 |
| 2006/0005668 | A1 * | 1/2006 | Knopp et al. | 81/57.39 |
| 2006/0053981 | A1 * | 3/2006 | Shaw et al. | 81/57.39 |

* cited by examiner

*Primary Examiner* — David B Thomas
(74) *Attorney, Agent, or Firm* — Johannes Schneeberger

(57) ABSTRACT

Centrally mounted in a strain decoupling fashion on a hydraulic torque wrench is a hose connect swivel. A base ring of the swivel features a first fluid transmitting joint that is fluid transmitting connected with axial studs extending from the base ring into mating holes in the torque wrench housing. The base ring is radially spaced apart and surrounding a central housing portion of the torque wrench. The radial spacing provides for a strain and deformation decoupling of the base ring from the torque wrench housing such that leakage in the fluid first transmitting joint is prevented. A second fluid transmitting joint provides together with the perpendicular first fluid transmitting joint for a three dimensional orienting of the hose connect terminal around the torque wrench housing while providing access to the piston side peripheral end of the torque wrench housing for an eventual reaction arm.

13 Claims, 7 Drawing Sheets

HYDRAULIC TORQUE WRENCH WITH CENTRAL STRAIN DECOUPLED GLOBAL HOSE CONNECT SWIVEL

FIELD OF INVENTION

The present invention relates to hydraulic torque wrenches with hose connect swivels. In particular, the present invention relates to hydraulic torque wrenches with hose connect swivels that are centrally connected to the main wrench housing in a strain decoupling fashion.

BACKGROUND OF INVENTION

Hydraulic torque wrenches are commonly utilized to tighten nuts and bolts by use of pressurized hydraulic fluid. Such nuts and bolts may be tightly spaced on flanges and the like, which requires the overall housing of the hydraulic torque wrench to be as small as possible. Tightly dimensioned torque wrench housings may result in significant strain and elastic deformation particularly along outside surfaces of the housing.

Hose connect swivels are known to be placed on the outside of hydraulic torque wrenches to adjust the connection position and orientation of the attached hydraulic hoses to varying operational space and positioning requirements. Unfortunately, the significant elastic housing deformations occurring during torque wrench operation may cause leakage in centrally attached prior art hose connect swivels. Therefore, there exists a need for a torque wrench with hose connect swivel that is substantially unaffected by strain and elastic deformation of the torque wrench's housing. The present invention addresses this need.

The torque exerted by the hydraulic torque wrench may need to be opposed by a reaction arm. Such well known reaction arms may need to be attached to the torque wrench most distant to the main wrench axis at the peripheral end of the piston end housing portion. The attachment of a reaction arm there induces additional strain and elastic deformation particularly to the piston side of the torque wrench housing. At the same time, the peripheral end of the piston side housing portion becomes unavailable to position there a hose connect swivel. Therefore, there exists a need for a hose connect swivel that may be attached centrally on the hydraulic torque wrench in a fashion that on one hand provides sufficient clearance to a reaction arm mounted on the piston side housing portion and on the other hand is unaffected by the additional strain and elastic deformation of a reaction arm that is mounted at the piston side of the housing. The present invention addresses also this need.

SUMMARY

A global hose connect swivel is circumferentially surrounding a piston side housing portion of a torque wrench in a strain decoupling fashion. At the same time, the global hose connect swivel is in a fluid transmitting connection with a ratchet side housing portion of the torque wrench. The strain decoupling fashion may be a structural radial spacing such that the hose connect swivel remains unaffected by eventual operational strain and elastic deformation of the piston side housing portion.

The fluid transmitting connection is preferably provided by a number of studs and mating holes that are oriented substantially in axial direction with respect to a piston oscillation axis of the torque wrench. The studs and mating holes have fluid channels that mate end to end while respective studs and mating holes are assembled. The studs and mating holes are preferably positioned immediately adjacent a central axial coupling face. In that way, the hose connect swivel may be conveniently assembled and disassembled by sliding it on and off the piston side housing portion. The fluid transmitting connection may be across the global swivel and the ratchet side housing portion and/or the piston side housing portion.

The studs and mating holes may be circumferentially evenly spaced to balance elastic deformation related to fluid pressure in a ring shaped first fluid transmitting joint of the hose connect swivel's base. The first fluid transmitting joint holds a swivel body and hose connect terminal rotationally free with respect to the piston oscillation axis.

Global swiveling of the hose connect terminal is accomplished by a second fluid transmitting joint in between the swivel body and the hose connect terminal. The second fluid transmitting joint holds the hose connect terminal rotationally free with respect to a swivel axis that is preferably perpendicular to the piston oscillation axis. Combined rotation around the first and second fluid transmitting joints provides global swiveling of the hose connect terminal centrally on the hydraulic torque wrench while providing access to the peripheral piston side housing end for attaching an eventual reaction arm.

DETAILED DESCRIPTION

Figure 1:
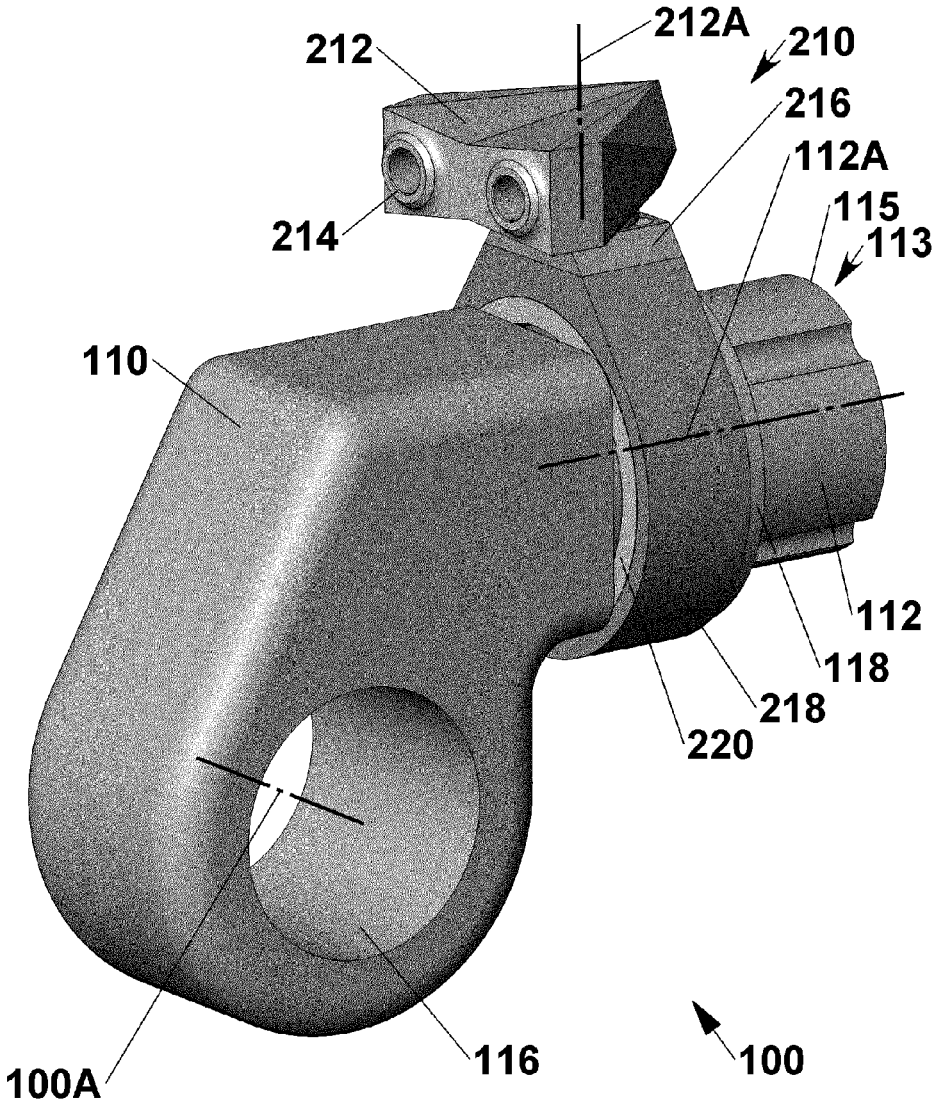
FIG. 1 is a first perspective view of a simplified hydraulic torque wrench with assembled global swivel.

Referring to FIGS. 1, 2, 6 and 7, a torque wrench 100 of the present invention has a ratchet side housing portion 110 and a piston side housing portion 112. The ratchet side housing portion 110 houses a well known ratchet mechanism that acts around the wrench axis 100A. Along the wrench axis 100A is an access hole 116 in the ratchet side housing portion 110 where the rotational torque movement of the ratchet mechanism may be externally accessed to tighten or loosen nuts or bolts as is well known in the art. The scope of the present invention includes well known configurations of the torque wrench 100 for externally accessing the rotational torque movement via features other than the access hole 116, such as for example a well known spline stud or the like.

Adjacent the ratchet side housing portion 110 is the piston side housing portion 112 that primarily houses a well known hydraulic piston that oscillates along a well known piston oscillation axis 112A. The hydraulic piston transforms in a well known fashion fluid pressure into a mechanical force and movement that drive the ratchet mechanism as is well known in the art. In context with the present invention, the piston side housing portion 112 is defined as that housing portion of the torque wrench 100 that on one hand has a cross section that is extending substantially continuous within a maximum outside cross section 115 along the piston oscillation axis 112A and/or on the other hand that houses substantially the well known cavity within which the well known hydraulic piston oscillates. The maximum outside cross section 115 is representatively depicted as the edge between the peripheral end 113 of the piston side housing portion 112. The piston side housing portion 112 may be configured with an outside spline with radially recessed and axially extending grooves 126 to eventually hold a well known reaction arm. The boundary between ratchet side housing portion 110 and piston side housing portion 110 may be a flange face 123. As in FIGS. 1 and 2 and according to a first embodiment of the invention, the flange face 123 may extend radially with respect to the piston oscillation axis 112A substantially beyond the maximum outside cross section 115.

Figure 2:
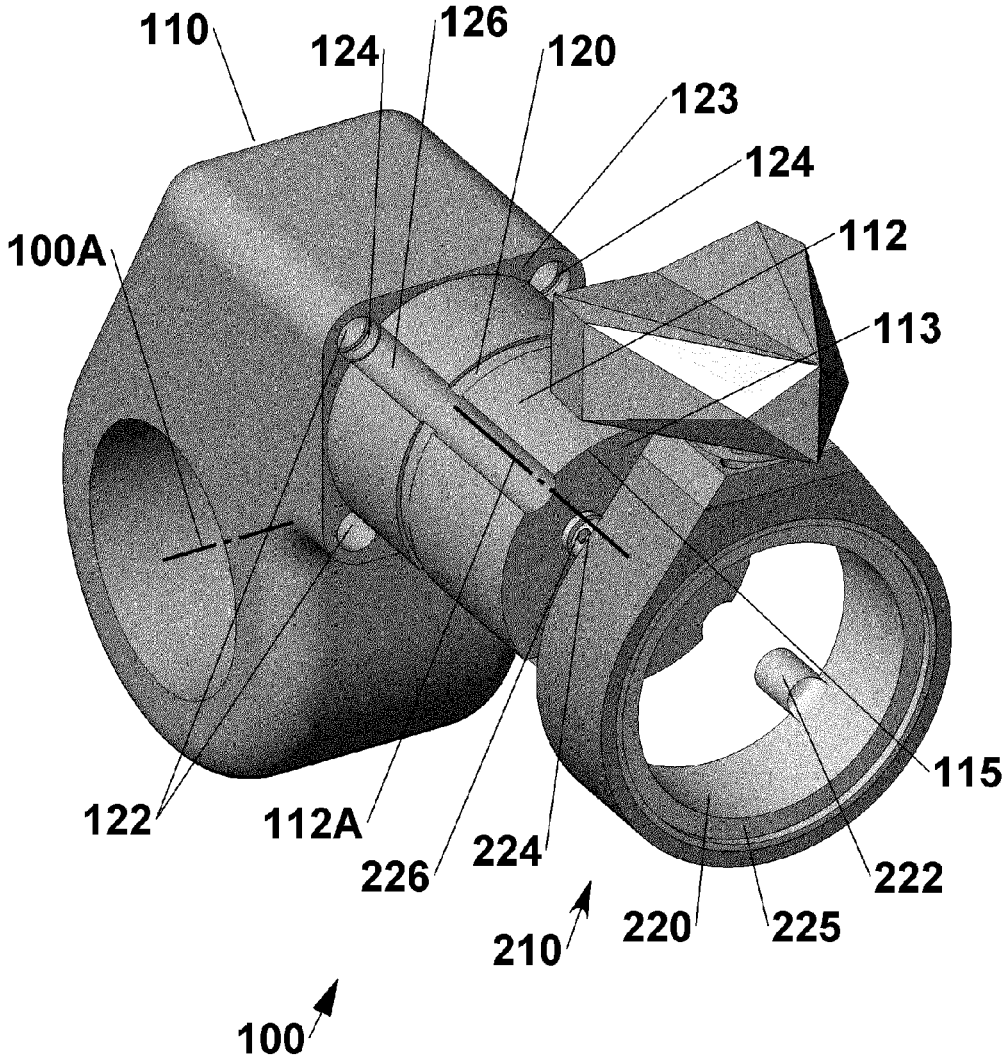
FIG. 2 is a second perspective view of the simplified hydraulic torque wrench of FIG. 1 with the disassembled global swivel of FIG. 1.

A hose connect swivel 210 is circumferentially surrounding the piston side housing portion 112 in a strain decoupling fashion while the hose connect swivel 210 is in a fluid transmitting connection with the ratchet side housing portion 110 as shown in FIGS. 1, 2 and in accordance with a first embodiment of the invention. According to a second embodiment of the invention as in FIGS. 6, 7, the fluid transmitting connection may be the piston side housing portion 112. The fluid transmitting connection is preferably provided by at least one of a number of studs 222 and at least one of a number of mating holes 122 that both feature fluid channels 124 and 224 that mate end to end in a fluid transfer interface while the hose connect swivel 210 is assembled at the torque wrench 100 as shown in FIG. 1, 2, 6, 7. In the first embodiment, the mating holes 124 are preferably recessed in the flange face 123. The mating holes 124 are also preferably aligned with respective ones of the radially recessed grooves 126. Consequently, the hose connect swivel 210 may be conveniently axially assembled with its studs 222 aligned with the radially recessed grooves 126 via the peripheral end 113 as shown in FIG. 2.

Figure 6:
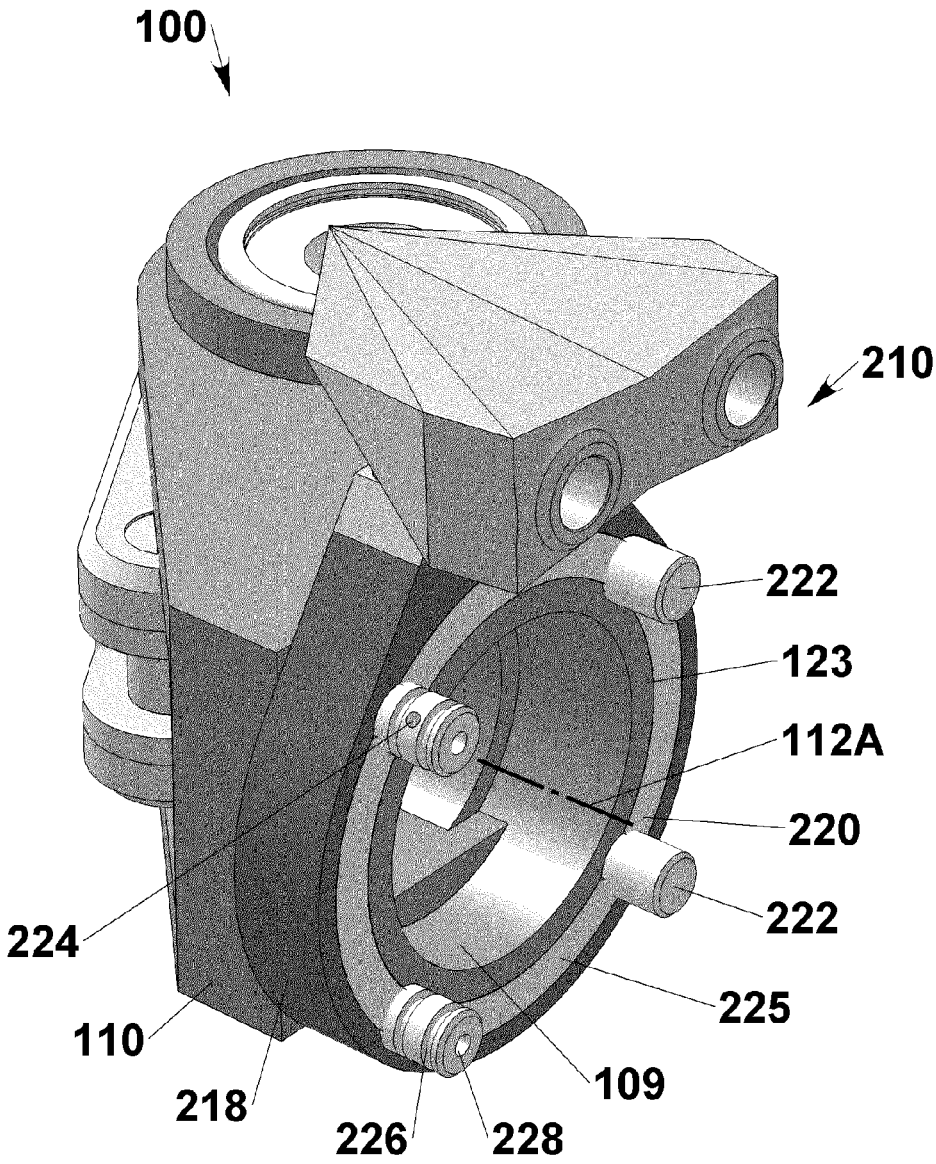
FIG. 6 is a second perspective view of a partial assembly of the second embodiment of the invention.
Figure 7:
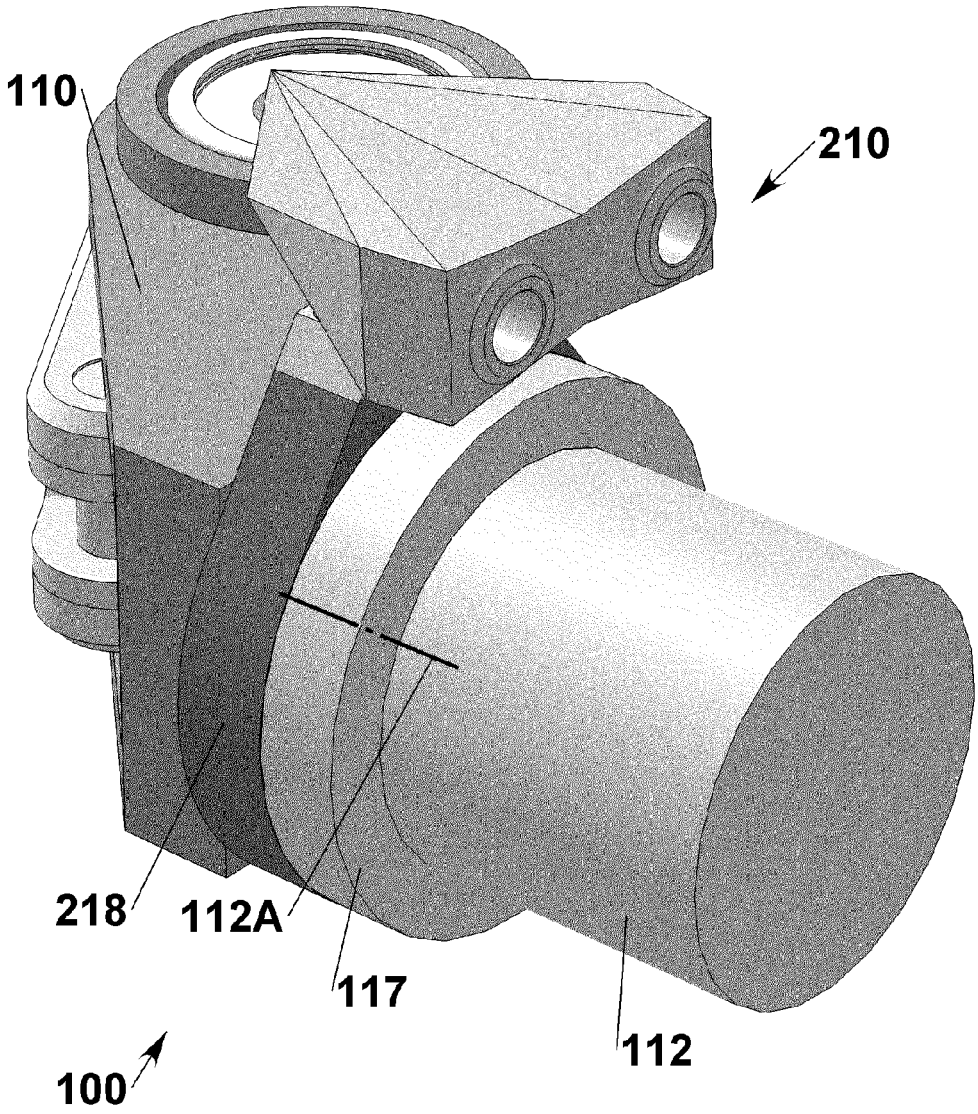
FIG. 7 is the second perspective view of the second embodiment of the invention.

In the second embodiment as in FIGS. 6, 7, the mating holes 124 may be recessed in the piston side housing portion 112 in general. In particular, the mating holes 124 may be recessed in a connect flange 117 of the piston side housing portion 112. The mating holes 124 are recessed in both embodiments in direction that is substantially axial with respect to the piston oscillation axis 112A. The mating holes 122 may alternately be part of the hose connect swivel 210 and the studs 122 be part of and extending from the ratchet side housing portion 110 and/or the piston side housing portion 112 as may be clear to anyone skilled in the art.

Figure 3:
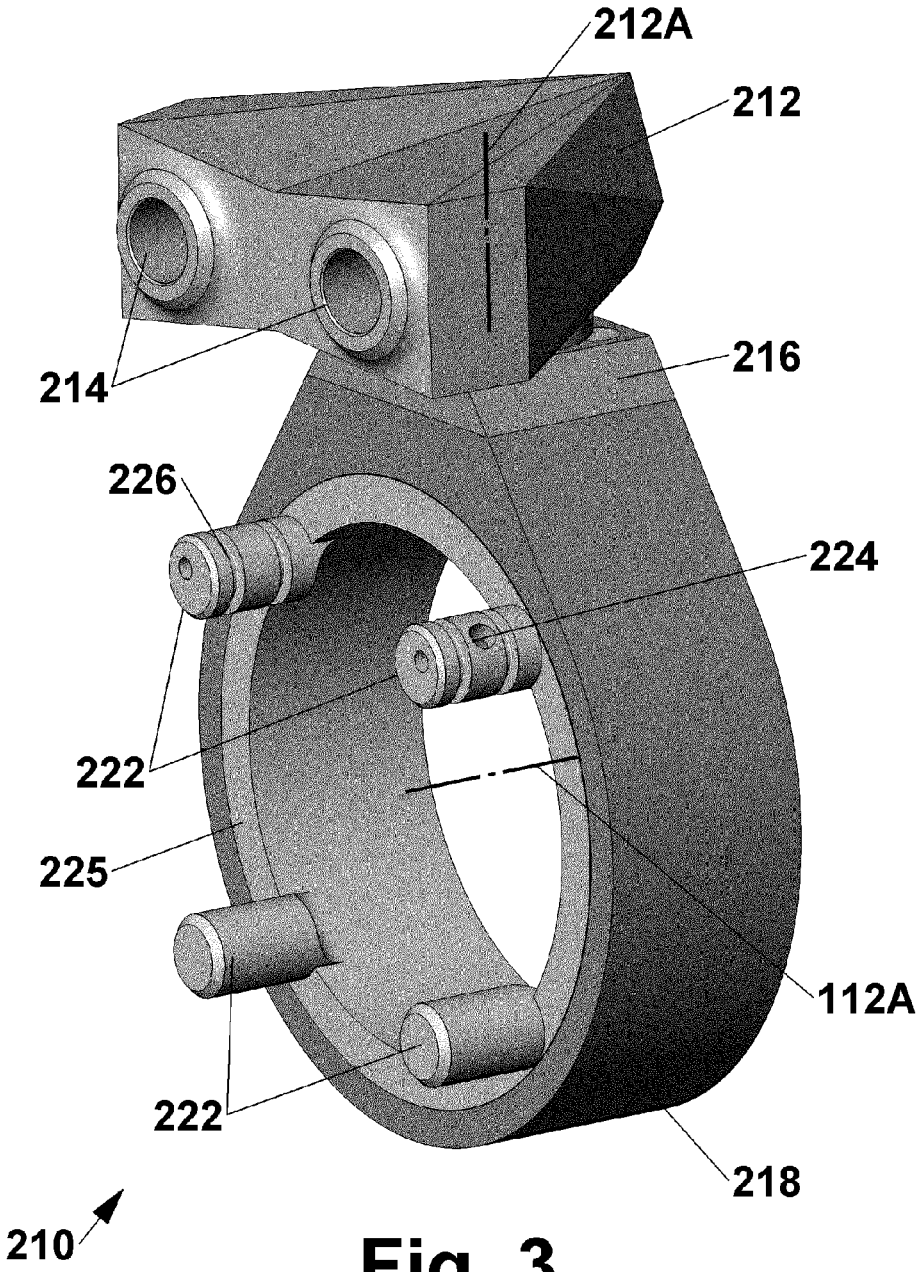
FIG. 3 is the first perspective view of the global swivel of FIG. 1 and FIG. 2.
Figure 4:
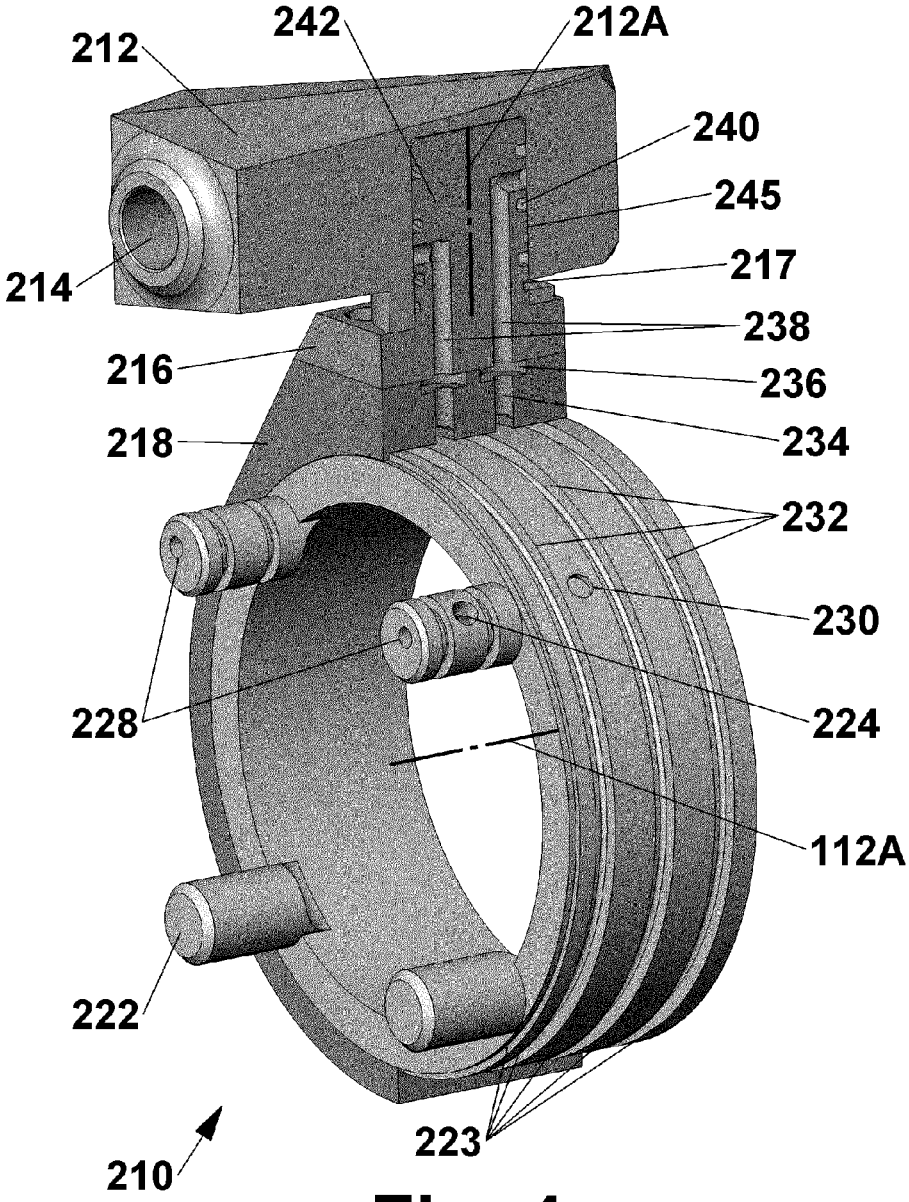
FIG. 4 is the global swivel of FIG. 3 in partial perspective cut view.
Figure 5:
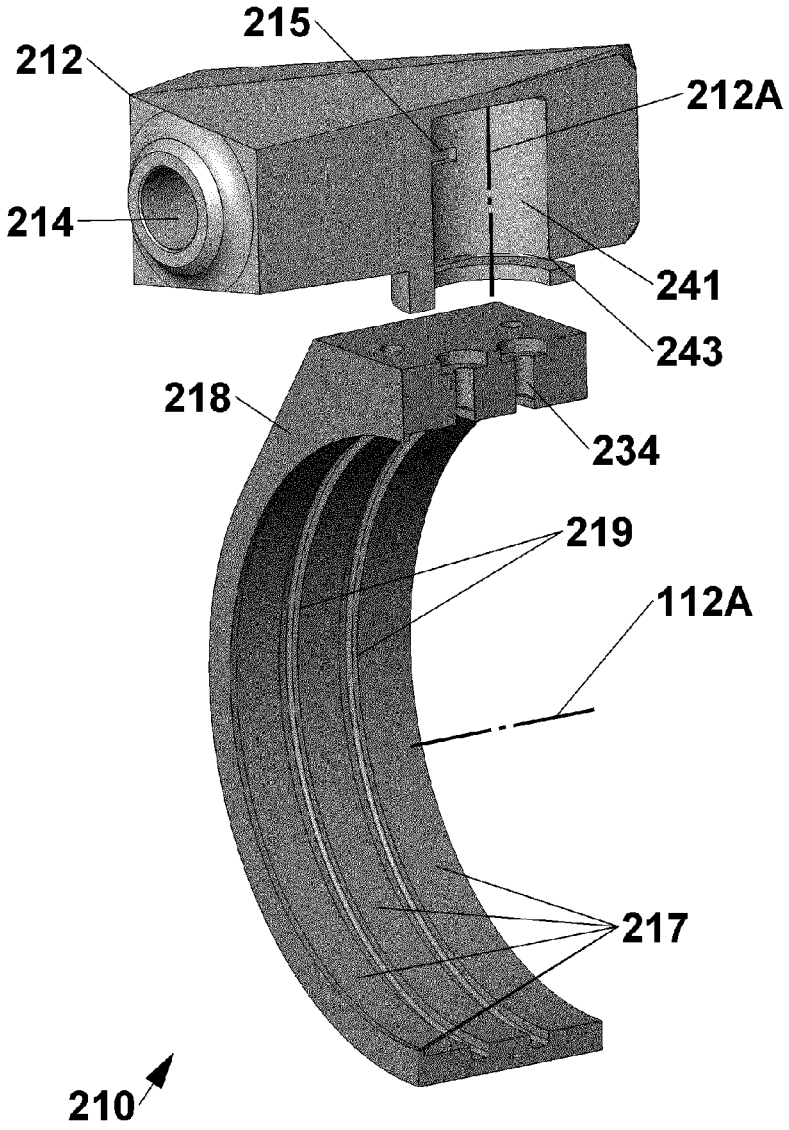
FIG. 5 is the global swivel of FIG. 4 without base ring and part of the swivel body.

Also referring to FIGS. 3, 4 and 5, further parts of the hose connect swivel 210 may preferably be a base ring 225 featuring the studs 222 and a swivel body 216, 218. The cut plane in FIGS. 4 and 5 is coincident with the oscillation axis 112A and the swivel axis 212A. The parts displayed in cut view in FIGS. 4 and 5 are the swivel body ring 218, the swivel body joint foot 216 and the hose connect terminal 212. Parts of the swivel body 216, 218 are a swivel body ring 218 and swivel body joint foot 216 that may be either attached to each other in a well known fashion and as is depicted in the FIGS. 1-4 or may be monolithically fabricated as may be well appreciated by anyone skilled in the art. Attachment screws of the swivel body joint foot 216 are not shown for clarity.

The swivel body 216, 218 is rotationally free connected to the base ring 225 via a first fluid transmitting joint 217, 219, 223, 230, 232, 234 such that the swivel body 216, 218 and the hose connect terminal 212 are together rotatable around the piston side housing portion 112 while the hose connect swivel 210 is in the fluid transmitting connection with the ratchet side housing portion 110. Part of the first fluid transmitting joint 217, 219, 223, 230, 232, 234 are mating gliding faces 217, 223, and circumferential fluid transfer channels 219 in communication with access channels 230, 234. Access channels 230 connect via respective axial holes 228 with respective interface holes 224. Further part of the first fluid transmitting joint are well known seal grooves 232 and well known seals (not shown for clarity) placed in the grooves 232 as is well known in the art.

A second fluid transmitting joint 215, 238, 240, 241, 243, 245 is rotationally free connecting the swivel body joint foot 216 with the hose connect terminal 212 such that the hose connect terminal 212 is rotatable with respect to the swivel body 216, 218 around a swivel axis 212A. The swivel axis 212A is at least in a substantial angle but preferably perpendicular to the piston oscillation axis 112A while the hose connect swivel 210 is fluid transmitting connected to the ratchet side housing portion 110. Part of the second fluid transmitting joint 215, 217, 238, 240, 241, 243, 245 are fluid transfer channels 215 connecting to respective well known hose accesses 214 and interfacing with respective circumferential fluid transfer channels 238 similar as channels 230, 219 and 234. Also part of the second fluid transmitting joint 215, 238, 240, 241, 243, 245 are cylindrical gliding faces 241, 245, seal grooves 240 with well known seals (omitted for clarity). An axial fixture 217, 243 includes a circumferential groove 217 on the joint stud 242 and a key slot 243 of the hose connect terminal 212 in which may be snapped in a well known snap ring (also omitted for clarity).

The hose connect terminal 212 with its hose accesses 214 is in fluid communication across the first fluid transmitting joint 217, 219, 223, 230, 232, 234 and across the second fluid transmitting joint 215, 238, 240, 241, 243, 245 preferably with two of the studs 222. Alternately and in case of the studs 222 extending from the ratchet side housing portion 110, the hose connect terminal 212 with its hose accesses 214 may be in fluid communication across the first fluid transmitting joint 217, 219, 223, 230, 232, 234 and across the second fluid transmitting joint 215, 238, 240, 241, 243, 245 with the mating holes 122.

The base ring 225 is preferably strain decoupled from the piston side housing portion 112 and/or the flange shaft 109 in a fashion that includes in the a radial structural spacing in between the piston side housing portion 112 and/or the flange shaft 109 on one side and the radial inside face 220 of the base ring 225 on the other side. The hose connect swivel 210 may be fixed on the hydraulic torque wrench 100 by employing at least two sets of studs 222 and mating holes 122. In the first embodiment, the hose connect swivel 210 may be axially fixed with respect to the piston oscillation axis 112A by a snap ring 118 outside adjacent the base ring 225 snapped in a groove 120 around the piston side housing portion 112. In the second embodiment, the swivel may be axially fixed by being sandwiched between the ratchet side housing portion 110 and piston side housing portion 112.

Overall outside dimensions of the hydraulic torque wrench 100 with the assembled hose connect swivel 210 are kept to a minimum by radially thinning the base ring 225 and the swivel body ring 218. To prevent leakage in the first fluid transmitting joint 217, 219, 223, 230, 232, 234 due to high hydraulic fluid pressure and minimal wall thicknesses of the affiliated parts 225, 218, studs 222 and mating holes 122 are preferably circumferentially substantially evenly arrayed with respect to the piston oscillation axis 112A. As a favorable result, fluid pressure related radial inward elastic deformation of the base ring 225 has even and reduced maxima in between adjacent studs 222. The studs 222 that feature fluid channels 224 may also feature seal grooves 226 and well known seals (not shown for clarity).

In the second embodiment of the invention of FIGS. 6, 7, the ratchet side housing portion 110 and the piston side housing portion 112 are preferable centrally separable. The flange face 123 may extend radially with respect to the piston oscillation axis 112A up to the maximum outside cross section 115 and may be at the peripheral end of a flange shaft 109 axially extending away from the ratchet side housing portion 110. The flange shaft 109 has an outside diameter that is smaller than an inside diameter of a base ring 225 such that the base ring 225 remains unaffected by eventual elastic deformation of the flange shaft 109.

Prior to using the torque wrench 100, the hose connect terminal 212 may be globally rotated around the piston oscillation axis 112A and around the swivel axis 212A, such that well known hydraulic hoses connected to the hose accesses 214 are kept out of the way. A reaction arm may be attached at the peripheral end 113. While pressurized hydraulic fluid is applied to the torque wrench 100 and the resulting torque is exerted onto a nut or bolt, the piston side housing portion 112 may experience elastic deformation. Since the base ring 225 is radially structurally decoupled from the piston side housing portion 112 and/or the flange shaft 109, radial and circumferential elastic deformation of the piston side housing portion 112 does not affect the first fluid transmitting joint 217, 219, 223, 230, 232, 234. Eventual axial deformation of the piston side housing portion 112 may be transmitted onto the base ring 225 in the first embodiment via the snap ring 118 but compensated by a limited free axial travel of the studs 222 within the respective mating holes 122. In the second embodiment, the base ring 225 may be axially sandwiched with sufficient clearance such that axial hydraulic load deformation in the interface between ratchet side housing portion 110 and piston side housing portion 112 does not substantially deform the base ring 225. Hence, in both embodiments is the risk of leakage in the sliding interface between base ring 225 and swivel body ring 218 substantially eliminated during loading of the torque wrench 100.

Accordingly, the scope of the invention described in the Figures and the Specification above is set forth by the following claims and their legal equivalent:

What is claimed is:

1. A hydraulic torque wrench comprising:

a. a ratchet side housing portion;

b. a piston side housing portion adjacent to said ratchet side housing portion, said piston side housing portion extending axially along a piston oscillation axis;

c. a hose connect swivel comprising a swivel body ring and a base ring that is rotationally free connected to said swivel body ring, wherein said base ring is circumferentially surrounding at least one of said piston side housing portion and said ratchet side housing portion while said base ring is radially strain decoupling spaced apart from at least one of said ratchet side housing portion and said piston side housing portion while said base ring is in a fluid transmitting connection with at least one of said ratchet side housing portion and said piston side housing portion.

2. The hydraulic torque wrench of claim 1, wherein:

a. said fluid transmitting connection comprises a stud and a mating hole;

b. wherein said stud and said mating hole comprise a fluid transfer interface;

c. wherein said stud and said mating hole are oriented substantially in axial direction with respect to said piston oscillation axis;

d. wherein one of said stud and said mating hole is part of said base ring; and e. wherein one other of said stud and said mating hole extends at a central axial coupling face of one of said piston side housing portion and said ratchet side housing portion, said central axial coupling face being immediately adjacent said base ring while said hose connect swivel is assembled on said hydraulic torque wrench.

3. The hydraulic torque wrench of claim 2, wherein said stud is part of said base ring and wherein said mating hole is part of at least one of said ratchet side housing portion and said piston side housing portion.

4. The hydraulic torque wrench of claim 2, wherein said mating hole is part of said base ring and wherein said stud is part of at least one of said ratchet side housing portion and said piston side housing portion.

5. The hydraulic torque wrench of claim 2, wherein a number of said stud and said mating hole are circumferentially substantially evenly arrayed with respect to said piston oscillation axis.

6. The hydraulic torque wrench of claim 1, wherein:

a. said base ring comprises one of a stud and a mating hole;

b. wherein said stud and said mating hole are oriented substantially in axial direction with respect to said piston oscillation axis;

c. wherein one of said stud and said mating hole is part of said base ring; and d. wherein one other of said stud and said mating hole extends at a central axial coupling face of one of said piston side housing portion and said ratchet side housing portion, said central axial coupling face being immediately adjacent said base ring while said hose connect swivel is assembled on said hydraulic torque wrench; and e. wherein said stud and said mating hole define a radially fix connection such that radial hydraulic pressure strain experienced by said base ring is transferred onto at least one of said piston housing portion and said ratchet side housing portion.

7. The hydraulic torque wrench of claim 6, wherein a number of said stud and said mating hole are circumferentially substantially evenly arrayed with respect to said piston oscillation axis such that said radial hydraulic pressure strain is circumferentially substantially evenly transferred onto at least one of said piston housing portion and said ratchet side housing portion.

8. The hydraulic torque wrench of claim 1, wherein said hose connect swivel further comprises:

a. a swivel body;

b. a hose connect terminal connected to said swivel body;

c. a base ring featuring a stud;

d. a first fluid transmitting joint that is rotationally free connecting said swivel body with said base ring such that said swivel body and said hose connect terminal are together rotatable around said piston side housing portion while said hose connect swivel is in said fluid transmitting connection; and wherein said hose connect terminal is in fluid communication with at least one of said stud and a mating hole across said first fluid transmitting joint.

9. The hydraulic torque wrench of claim 8, further comprising a second fluid transmitting joint that is rotationally free connecting said swivel body with said hose connect terminal such that said hose connect terminal is rotatable with respect to said swivel body around a swivel axis that is in a substantial angle to said piston oscillation axis while said hose connect swivel is in said fluid transmitting connection; and wherein said hose connect terminal is in fluid communication with at least one of said stud and said mating hole across said second fluid transmitting joint.

10. The hydraulic torque wrench of claim 1, wherein said strain decoupled fashion comprises a radial structural spacing between said piston side housing portion and a base ring of said hose connect swivel.

11. The hydraulic torque wrench of claim 1, wherein said fluid transmitting connection is with said ratchet side housing portion.

12. The hydraulic torque wrench of claim 1, wherein said fluid transmitting connection is with said piston side housing portion.

13. The hydraulic torque wrench of claim 12, wherein said piston side housing portion is separable from said ratchet side housing portion.

* * * * *